US007824014B2

(12) United States Patent
Furukawa et al.

(10) Patent No.: US 7,824,014 B2
(45) Date of Patent: Nov. 2, 2010

(54) HEAD SUBSTRATE, PRINTHEAD, HEAD CARTRIDGE, AND PRINTING APPARATUS

(75) Inventors: Tatsuo Furukawa, Zama (JP); Nobuyuki Hirayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 490 days.

(21) Appl. No.: 11/948,499

(22) Filed: Nov. 30, 2007

(65) Prior Publication Data

US 2008/0129791 A1 Jun. 5, 2008

(30) Foreign Application Priority Data

Dec. 5, 2006 (JP) ..... 2006-328836

(51) Int. Cl.
*B41J 2/14* (2006.01)
*B41J 2/16* (2006.01)

(52) U.S. Cl. ..... 347/50; 347/58; 347/12; 347/40

(58) Field of Classification Search ..... 347/12–13, 347/40–42, 50, 56–59
See application file for complete search history.

(56) References Cited

U.S. PATENT DOCUMENTS 6,290,334 B1 9/2001 Ishinaga et al.
6,712,437 B2 3/2004 Furukawa et al.
6,824,237 B2 11/2004 Hirayama et al.
7,133,153 B2 11/2006 Furukawa
7,321,444 B2 1/2008 Hirayama
7,354,125 B2 * 4/2008 Hirayama et al. ..... 347/12
2005/0134620 A1 6/2005 Hirayama et al.
2006/0284909 A1 12/2006 Kasai et al.
2007/0002340 A1 1/2007 Furukawa

FOREIGN PATENT DOCUMENTS

JP 2006-88648 4/2006
WO WO 2006/009235 1/2006

* cited by examiner

*Primary Examiner*—Juanita D Stephens
(74) *Attorney, Agent, or Firm*—Fitzpatrick, Cella, Harper & Scinto

(57) ABSTRACT

The purpose of this invention is to provide a head substrate capable of increasing layout efficiency. To achieve this purpose, an ink supply channel is arranged, and a plurality of printing element arrays are arranged on at least one side of the ink supply channel, and a plurality of driving element arrays are arranged adjacent to the plurality of printing element arrays. A plurality of power supply pads and a plurality of ground pads are arranged in areas between the plurality of driving element arrays.

10 Claims, 15 Drawing Sheets

HEAD SUBSTRATE, PRINTHEAD, HEAD CARTRIDGE, AND PRINTING APPARATUS

BACKGROUND OF THE INVENTION

1. Field of the Invention

The present invention relates to a head substrate, printhead, head cartridge, and printing apparatus. Particularly, the present invention relates to a head substrate prepared by forming, on the same substrate, an electrothermal transducer for generating heat energy necessary to print, and a driver circuit for driving the electrothermal transducer, a printhead using the head substrate, a head cartridge using the printhead, and a printing apparatus.

2. Description of the Related Art

The electrothermal transducers (heaters) and driver circuits of a printhead mounted in a conventional inkjet printing apparatus are formed on the same substrate by a semiconductor process technique as disclosed in, for example, U.S. Pat. No. 6,290,334. There has already been proposed a substrate on which an ink supply channel for supplying ink is arranged on the substrate and heaters are arrayed at positions opposite to each other near the ink supply channel.

FIG. 10 is a view showing the layout of a head substrate used in a conventional inkjet printhead.

In FIG. 10, a substrate 100 is formed by integrating, by a semiconductor process technique, heaters and driver circuits for driving them. Each heater array 101*a* is an array of heaters. Each driver array (driving element array) 101*b* is an array of driver transistors (driving elements) for switching between supplying a desired current and not supplying the current to heaters. An ink supply channel 102 supplies ink from the back surface of the substrate. Each shift register (S/R) 103 temporarily stores print data. Each latch circuit 104 latches print data stored in the corresponding shift register (S/R) 103 at once. Each decoder 105 selects a desired heater block of the heater array 101*a* in unit of concurrently drivable block so as to drive it. Each input circuit block 106 includes a buffer circuit for inputting digital signals to the shift register 103 and decoder 105. Signal lines 107 transmit signals from the shift register 103 and decoder 105 to select individual segments in the heater array 101*a* and driver array 101*b*.

Each converter array 108 is an array of level converters which convert, into driving voltages to be applied to the gates of the driver transistors, the amplitude voltages of output signal pulses, from the shift register 103 and decoder 105, that are transferred via the signal lines 107. Each converted voltage generation circuit 109 generates a driving voltage for the level converters of the converter array 108. Each contact pad 110 is used to input/output an electrical signal from/to outside the substrate.

FIG. 11 is a circuit diagram showing an equivalent circuit corresponding to one segment (one heater) of the heater array 101*a* and driver array 101*b* which are integrated on the head substrate shown in FIG. 10 and drive heaters for discharging ink.

In FIG. 11, an AND circuit 201 calculates the logical product of two input signals. The AND circuit 201 receives a block selection signal which is sent from the decoder 105 to select heaters of each block, and a print data signal which is transferred to the shift register 103 and latched by the latch circuit 104. Based on the logical product, each segment can be selectively turned on. An inverter circuit 202 buffers an output from the AND circuit 201. A VDD power supply line 203 serves as the power supply of the inverter circuit 202. An inverter circuit 204 buffers an output from the inverter circuit 202. A VH power supply line 205 is used for supplying a voltage to be applied to a heater. A driver transistor 207 serves as a switching element for switching between supplying a current and not supplying the current, to a heater 206. A VHTM power supply line 208 serves as a power supply for supplying power to the inverter circuit 204 functioning as a buffer, thereby applying a gate voltage to the driver transistor 207.

A current flowing through the heater 206 is fed back to a ground line (GNDH) 209. A level converter 210 is made up of a plurality of inverter circuits 204, and converts the amplitude voltage of an output pulse from the AND circuit 201 into the gate driving voltage of the driver transistor. A VSS voltage line 211 provides the GND potential of the inverter circuits 202 and 204.

A circuit (to be referred to as a converted voltage generator hereinafter) 220 corresponds to one segment of the converted voltage generation circuit 109 which internally converts a voltage (VHT voltage) of a VHT power supply line into a voltage VHTM for driving the driver transistor 207.

A VHT power supply line 223 supplies a voltage which is the source of the VHTM voltage in the converted voltage generator 220. A MOSFET transistor 222 serves as a buffer for output. Dividing resistors 221*a* and 221*b* determine the gate voltage of the MOSFET transistor 222. A load resistor 225 is connected to the source of the MOSFET transistor 222.

The voltage VHTM is desirably adjusted to make the ON resistance of the driver transistor 207 sufficiently low. The voltage VHTM is set higher than the VDD voltage, and lower than the tolerable voltage of the element of the level converter 210. More specifically, the converted voltage generator 220 employs a so-called source follower arrangement. The value of the converted voltage (voltage VHTM) is determined by applying a predetermined reference voltage to the gate of the MOSFET transistor 222. In this circuit arrangement, by always applying a predetermined voltage to the gate of the MOSFET transistor 222, the converted potential hardly varies even by a current flowing through the drain-source path.

FIG. 12 is an equivalent circuit diagram of a circuit corresponding to one bit of the shift register 103 and latch circuit 104 which temporarily store print data.

In FIG. 12, print data DATA is input to the shift register in synchronism with a clock CLK, and the input print data is latched in synchronism with a latch signal LT. When a heat enable signal HE is input, a print data signal is output from the latch circuit to the AND circuit 201 while the heat enable signal is enabled.

FIG. 13 is a timing chart for explaining a series of operations from receiving print data in the shift register 103 to driving the heater 206 by supplying a current to it.

In FIG. 13, print data is supplied to a data pad (not shown) in synchronism with the clock CLK input to a clock pad (not shown). The shift register 103 temporarily stores the print data. The latch circuit 104 latches the print data in synchronism with the latch signal LT supplied to a latch pad (not shown). Then, the logical product of a block selection signal for selecting heaters of a desired block, and a print data signal output in accordance with the latch signal LT is calculated. A heater current (current VH) flows in synchronism with the heat enable signal HE, which directly determines a current driving time, and the logical product.

Printing is performed by repeating the series of operations for respective blocks.

FIG. 14 is a view showing connection of power supply wiring lines in the head substrate shown in FIG. 10.

In FIG. 14, power supply pads VH 130, 132, 134, and 136 supply voltages to be applied to heaters. Ground pads GND 131, 133, 135, and 137 correspond to the power supply pads.

Wiring lines 140 are divided to independently supply power from the power supply pads VH to respective blocks. Wiring lines 141 are divided to feed back power from the blocks to the ground pads GND. These wiring lines will be called VH power supply wiring lines and GND wiring lines.

Segments including heaters arranged on the head substrate are divided into 16 groups A to P. Power is independently supplied and fed back to and from each group in order to keep power loss constant by making uniform the wiring resistances of the VH power supply wiring lines and GND wiring lines which are connected to the respective groups. The widths of the wiring lines are adjusted to have the same resistance value. Each group is comprised of segments (including heaters), respectively belonging to different time-divisionally driven blocks.

FIG. 15 is a layout view showing connection of power supply wiring lines in the head substrate shown in FIG. 14.

In FIG. 15, reference numeral 171 denotes a heater; and 172, a MOSFET which is a driver transistor corresponding to one heater. Reference numeral 175 denotes a drain electrode of the MOSFET 172 series-connected to the heater 171; 177, a gate electrode of the MOSFET 172; and 176, a source electrode of the MOSFET 172.

Segments corresponding to heaters are divided into groups 170. A current is independently supplied and fed back to and from each group.

VH power supply wiring lines 180*a* to 180*c* supply power to respective groups. Currents supplied from the VH power supply wiring lines are fed back through GND wiring lines 181*a* to 181*c*. The VH power supply wiring lines 180*a* to 180*c* and GND wiring lines 181*a* to 181*c* are divided to independently supply the VH power and ground to respective groups. The widths of the wiring lines are adjusted to have the same resistance value.

In FIG. 15, the VH power supply wiring lines are laid out above heaters for descriptive convenience. The wiring lines may also be three-dimensionally formed on driver transistors by a multi-layer wiring technique.

However, according to the power supply wiring connection as shown in FIG. 14, the wiring becomes longer as the longer side of the chip (head substrate) becomes longer. In addition, as the group division count increases, the widths of wiring lines independently connected to respective groups become narrower, and the wiring resistance tends to rise as a whole. The increase in wiring resistance causes so-called power loss because power, which should be originally consumed by heaters, is consumed by the wiring to a certain degree. If the original power supply voltage is increased to compensate for the power loss, this adversely affects the durable service life of heaters. Further, heat generated by power consumption by the wiring raises the temperature of the printhead itself, adversely affecting the ink discharge characteristic.

If the width of the power wiring is made wider to decrease the resistance value of the wiring, the layout efficiency decreases, the chip area increases, and the printhead cost rises.

SUMMARY OF THE INVENTION

Accordingly, the present invention is conceived as a response to the above-described disadvantages of the conventional art.

For example, a head substrate according to this invention is capable of reducing power loss, increasing the layout efficiency, and reducing the substrate area by suppressing the wiring resistance for power supply.

According to one aspect of the present invention, preferably, there is provided a head substrate used in an inkjet printhead, comprising: an ink supply channel which is arranged along a longer side direction of the head substrate; a plurality of printing element arrays which are arranged on at least one side of the ink supply channel, and each of which has a plurality of printing elements for printing by discharging ink supplied from the ink supply channel; a plurality of driving element arrays which are arranged adjacent to the plurality of printing element arrays on the same side of the ink supply channel as the side on which the plurality of printing element arrays are arranged, and which have a plurality of driving elements for driving the plurality of printing elements forming the plurality of printing element arrays; a plurality of power supply pads which are arranged in areas between the plurality of driving element arrays along the longer side direction of the head substrate, and supply power to the plurality of printing elements of neighboring printing element arrays out of the plurality of printing element arrays; and a plurality of ground pads which are arranged in the areas and correspond to the plurality of power supply pads.

According to another aspect of the present invention, preferably, there is provided a printhead using a head substrate described above.

According to still another aspect of the present invention, preferably, there is provided a head cartridge integrating the above printhead and an ink tank containing ink to be supplied to the printhead.

According to still another aspect of the present invention, preferably, there is provided a printing apparatus using the above printhead.

The invention is particularly advantageous since a power supply pad and ground pad are arranged in an area between adjacent driving element arrays, and power is supplied to neighboring printing element arrays from the power supply pad. The wiring lengths between the pads, and the printing element arrays and driving element arrays are shortened. Hence, the wiring resistance for power supply can be suppressed to reduce power loss. Also, deterioration of the print characteristic by the temperature rise of the printhead caused by the power loss, and shortening of the durable service life of the printing element can be prevented.

Since the area on the head substrate can be efficiently utilized, this contributes to downsizing the head substrate and reducing the costs of the head substrate and printhead.

Further features of the present invention will become apparent from the following description of exemplary embodiments with reference to the attached drawings.

DESCRIPTION OF THE EMBODIMENTS

Figure 1:
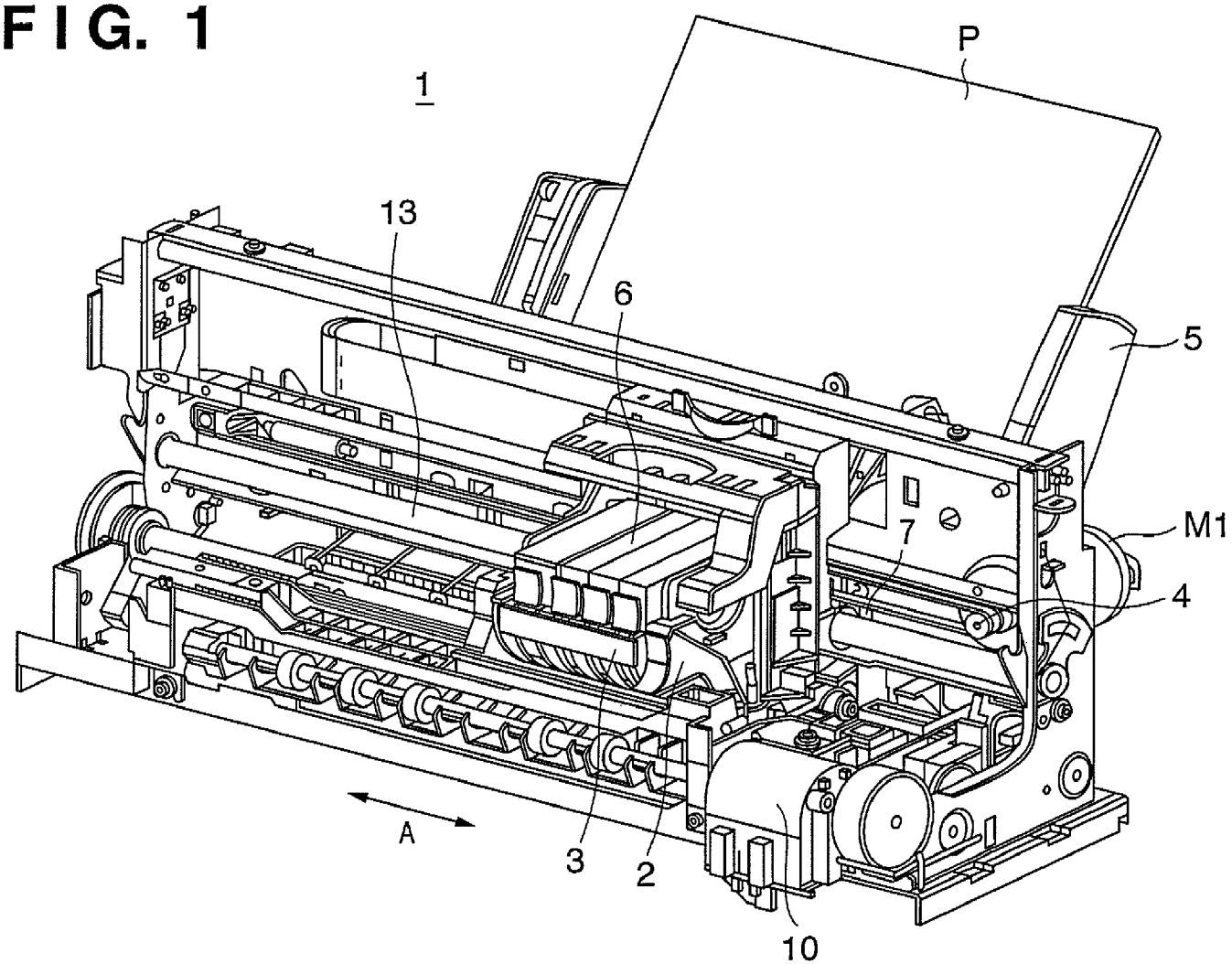
FIG. 1 is a schematic perspective view showing the outer appearance of the structure of an inkjet printing apparatus as a typical embodiment of the present invention.

Preferred embodiments of the present invention will now be described in detail in accordance with the accompanying drawings. The same reference numerals denote the same parts, and a description thereof will not be repeated.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

The term "printhead substrate (head substrate)" in the description not only includes a simple substrate made of a silicon semiconductor, but also broadly includes a substrate with elements, wiring lines, and the like.

The expression "on a substrate" not only includes "on an element substrate", but also broadly includes "on the surface of an element substrate" and "inside of an element substrate near its surface". The term "built-in" in the present invention not only includes "simply arrange separate elements on a substrate surface", but also broadly includes "integrally form and manufacture elements on an element substrate by a semiconductor circuit manufacturing process or the like".

<Description of Inkjet Printing Apparatus (FIG. 1)>

FIG. 1 is a schematic perspective view showing the outer appearance of the structure of an inkjet printing apparatus 1 as a typical embodiment of the present invention.

In the inkjet printing apparatus (to be referred to as a printing apparatus hereinafter), as shown in FIG. 1, a carriage 2 supports a printhead 3 for printing by discharging ink according to the inkjet method. A transmission mechanism 4 transmits a driving force generated by a carriage motor Ml to the carriage 2, and the carriage 2 can reciprocate in directions indicated by an arrow A. In printing, a print medium P such as print paper is fed via a paper feed mechanism 5 and conveyed to a print position. At the print position, the printhead 3 prints by discharging ink to the print medium P.

To maintain a good state of the printhead 3, the carriage 2 moves to the position of a recovery device 10. The recovery device 10 intermittently performs a discharge recovery operation for the printhead 3.

The carriage 2 of the printing apparatus 1 supports not only the printhead 3, but also an ink cartridge 6 which contains ink to be supplied to the printhead 3. The ink cartridge 6 is detachable from the carriage 2.

The printing apparatus 1 shown in FIG. 1 can print in color. For this purpose, the carriage 2 supports four ink cartridges which respectively contain magenta (M), cyan (C), yellow (Y), and black (K) inks. The four ink cartridges are independently detachable.

The carriage 2 and printhead 3 can achieve and maintain a predetermined electrical connection by properly bringing their contact surfaces into contact with each other. The printhead 3 selectively discharges ink from a plurality of orifices and prints by applying energy in accordance with print data. In particular, the printhead 3 according to the embodiment employs an inkjet method of discharging ink by using heat energy. For this purpose, the printhead 3 comprises an electrothermal transducer for generating heat energy. Electric energy applied to the electrothermal transducer is converted into heat energy. Ink is discharged from orifices by using a change in pressure upon growth and shrinkage of bubbles due to film boiling generated by applying the heat energy to ink. The electrothermal transducer is arranged in correspondence with each orifice, and ink is discharged from a corresponding orifice by applying a pulse voltage to a corresponding electrothermal transducer in accordance with print data.

As shown in FIG. 1, the carriage 2 is coupled to part of a driving belt 7 of the transmission mechanism 4 which transmits the driving force of the carriage motor M1. The carriage 2 is slidably guided and supported along a guide shaft 13 in the directions indicated by the arrow A. The carriage 2 reciprocates along the guide shaft 13 by normal rotation and reverse rotation of the carriage motor M1.

The printing apparatus 1 has a platen (not shown) facing the orifice surface of the printhead 3 having orifices (not shown). The carriage 2 supporting the printhead 3 reciprocates by the driving force of the carriage motor M1. At the same time, the printhead 3 receives print data to discharge ink and print on the entire width of the print medium P conveyed onto the platen.

<Control Arrangement of Inkjet Printing Apparatus (FIG. 2)>

Figure 2:
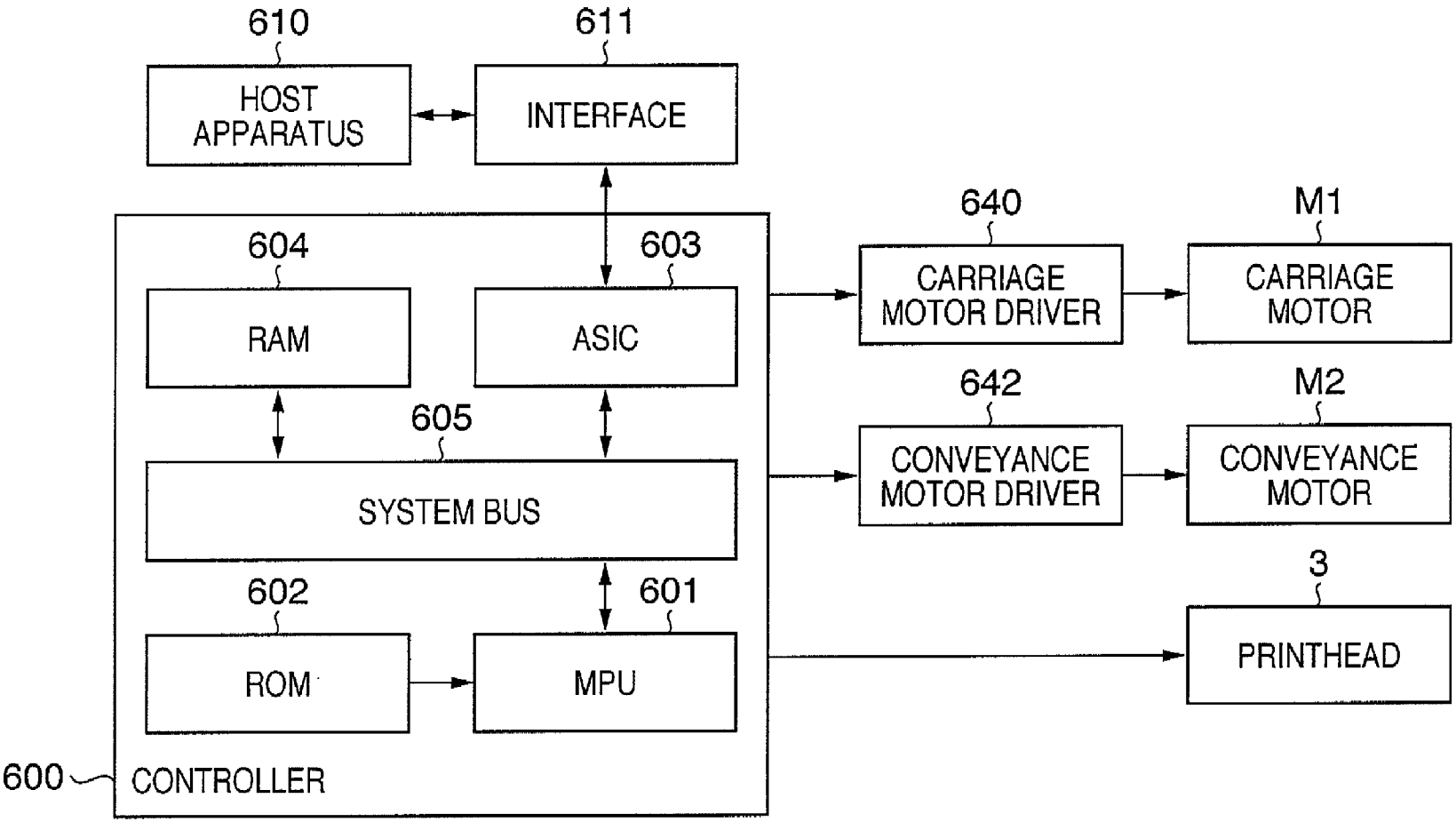
FIG. 2 is a block diagram showing the arrangement of the control circuit of the printing apparatus.

FIG. 2 is a block diagram showing the control arrangement of the printing apparatus shown in FIG. 1.

As shown in FIG. 2, a controller 600 comprises a MPU 601, ROM 602, ASIC (Application Specific Integrated Circuit) 603, RAM 604, and system bus 605. The ROM 602 stores a program corresponding to a control sequence, a predetermined table, and other permanent data. The ASIC 603 generates control signals for controlling the carriage motor M1, a conveyance motor M2, and the printhead 3. The RAM 604 is used as an image data expansion area, a work area for executing a program, and the like. The system bus 605 connects the MPU 601, ASIC 603, and RAM 604 to each other, and allows exchanging data.

In FIG. 2, a computer (or an image reader, digital camera, or the like) 610 serves as an image data source and is generally called a host apparatus. The host apparatus 610 and printing apparatus 1 transmit/receive image data, commands, status signals, and the like via an interface (I/F) 611.

A carriage motor driver 640 can drive the carriage motor M1 for reciprocating the carriage 2 in the directions indicated by the arrow A. A conveyance motor driver 642 drives the conveyance motor M2 for conveying the print medium P.

The ASIC 603 transfers print data DATA of a printing element (heater for ink discharge) to the printhead while directly accessing the storage area of the RAM 604 in printing and scanning by the printhead 3.

The ink cartridge 6 and printhead 3 are separable from each other, as described in FIG. 1, but may also be integrated into an exchangeable head cartridge.

Figure 3:
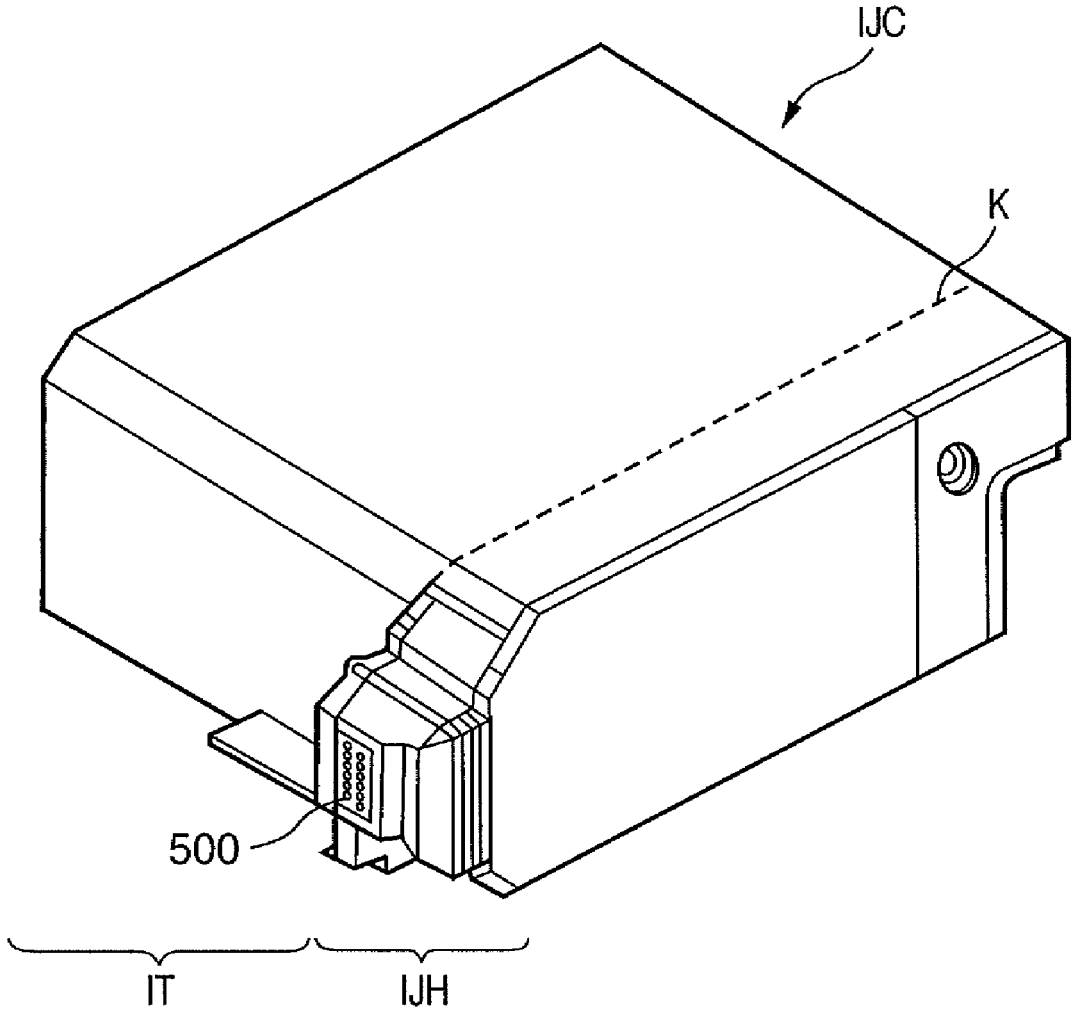
FIG. 3 is a perspective view showing the outer appearance of the structure of a head cartridge IJC which integrates an ink tank and printhead.

FIG. 3 is a perspective view showing the outer appearance of the structure of the head cartridge IJC which integrates the ink tank and printhead. In FIG. 3, a dotted line K indicates the boundary between an ink tank IT and a printhead IJH. The head cartridge IJC has an electrode (not shown) to receive an electrical signal supplied from the carriage 2 when the head cartridge IJC is mounted on the carriage 2. The electrical signal drives the printhead IJH to discharge ink, as described above.

In FIG. 3, reference numeral 500 denotes an ink orifice array. Each orifice corresponds to each heater for ink discharge provided on a head substrate, and is provided in a position opposite to the heater FIG. 4 is a view showing the layout of the head substrate integrated into the printhead 3.

Figure 4:
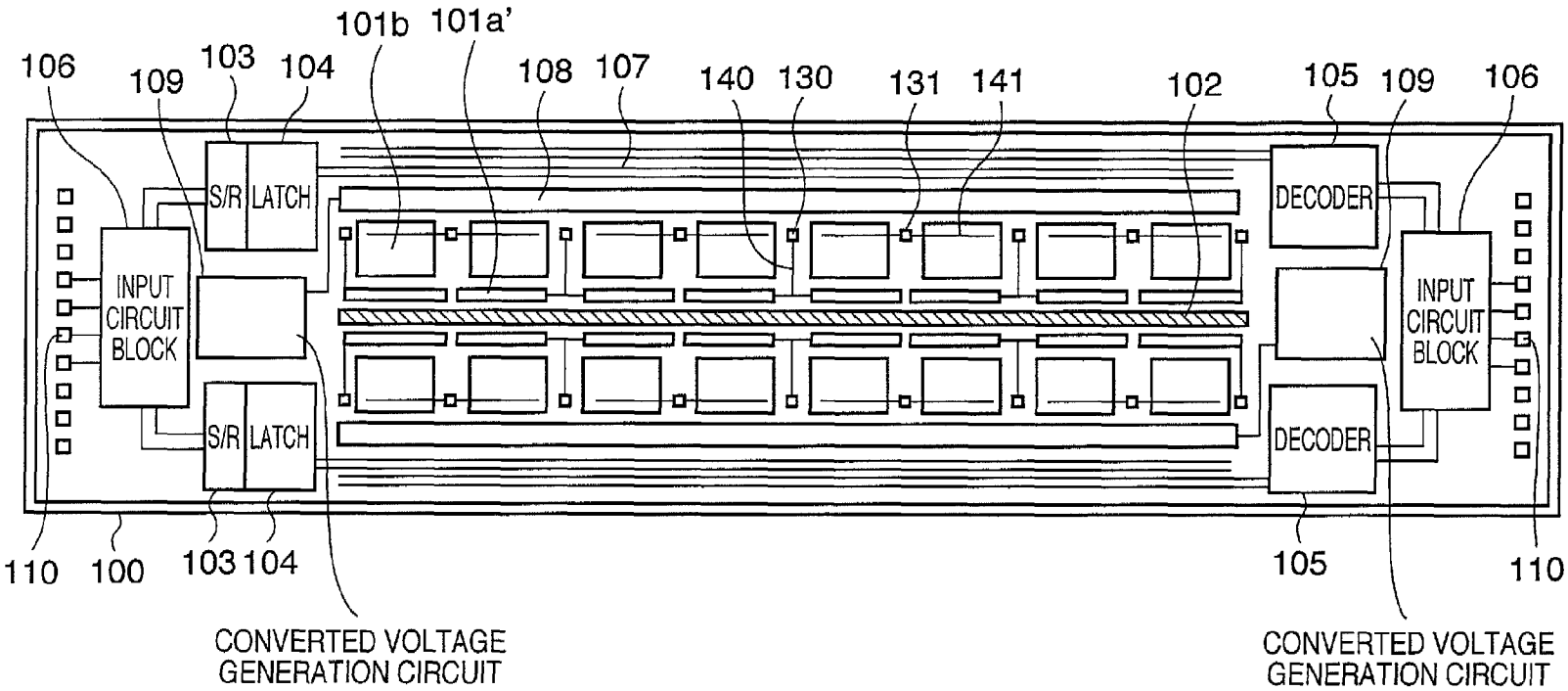
FIG. 4 is a view showing the layout of a head substrate according to an embodiment of the present invention.
Figure 10:
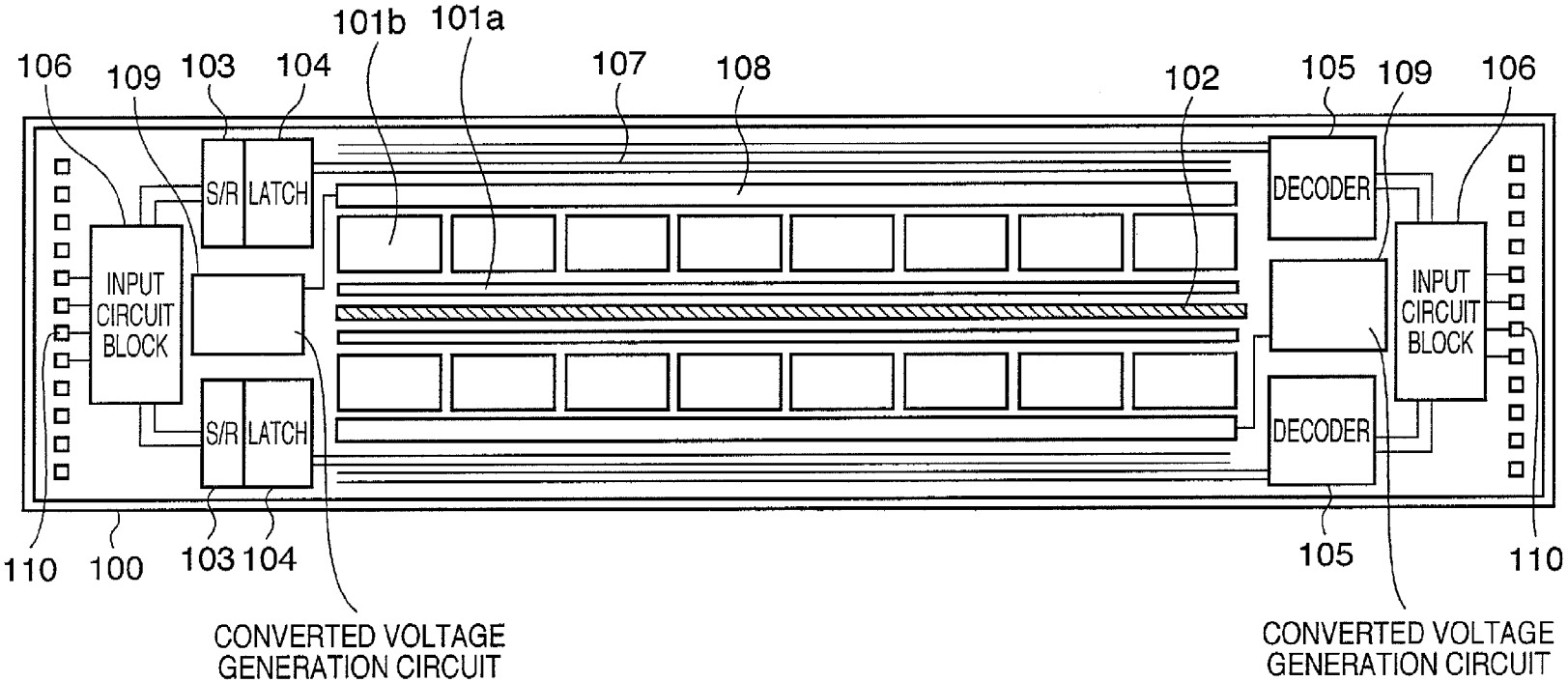
FIG. 10 is a view showing the layout of a conventional head substrate.
Figure 11:
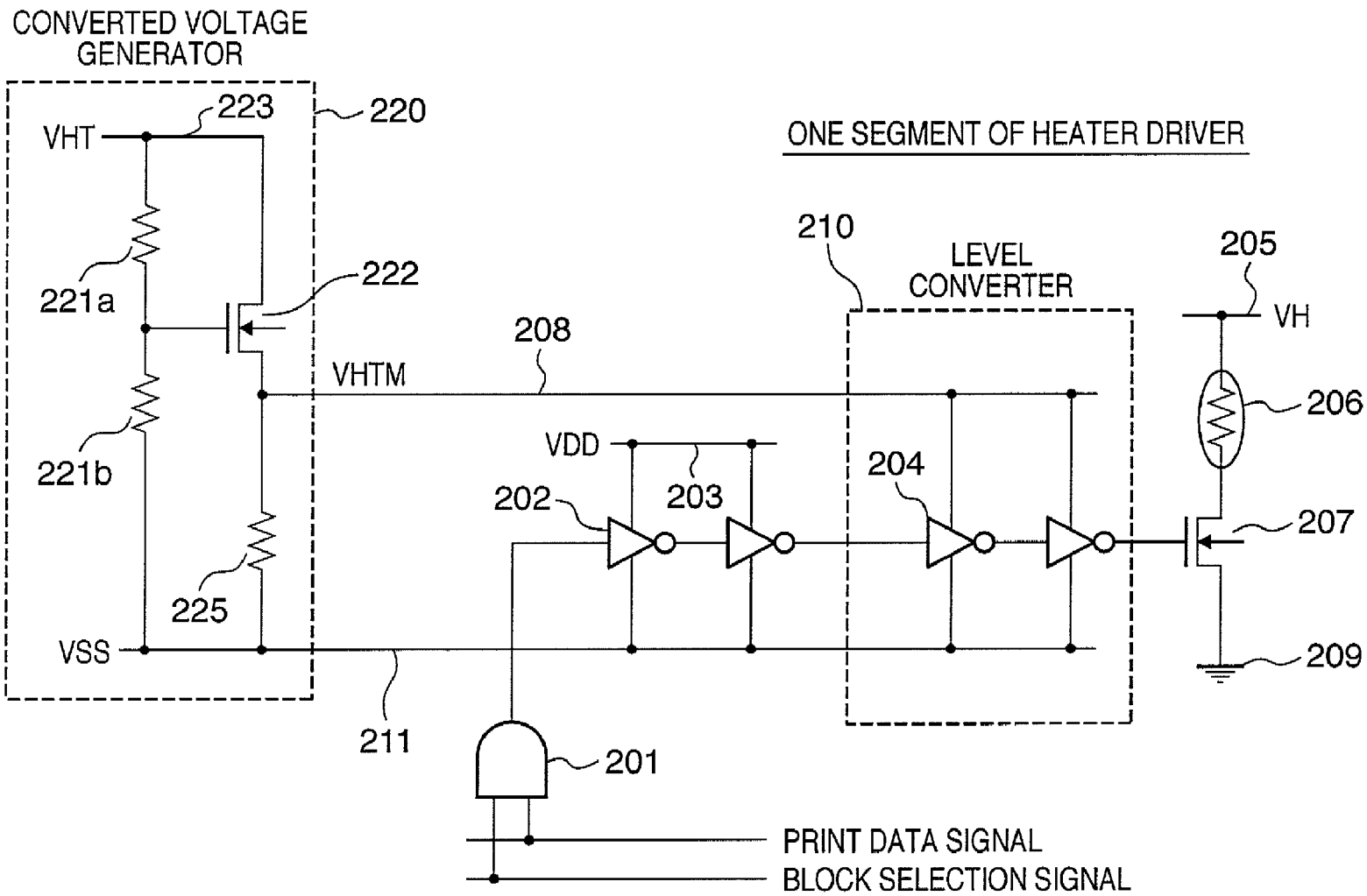
FIG. 11 is a circuit diagram showing an equivalent circuit corresponding to one segment of a heater array 101*a* and driver array 101*b* which are mounted on the head substrate shown in FIG. 10 and drive heaters for discharging ink.
Figure 12:
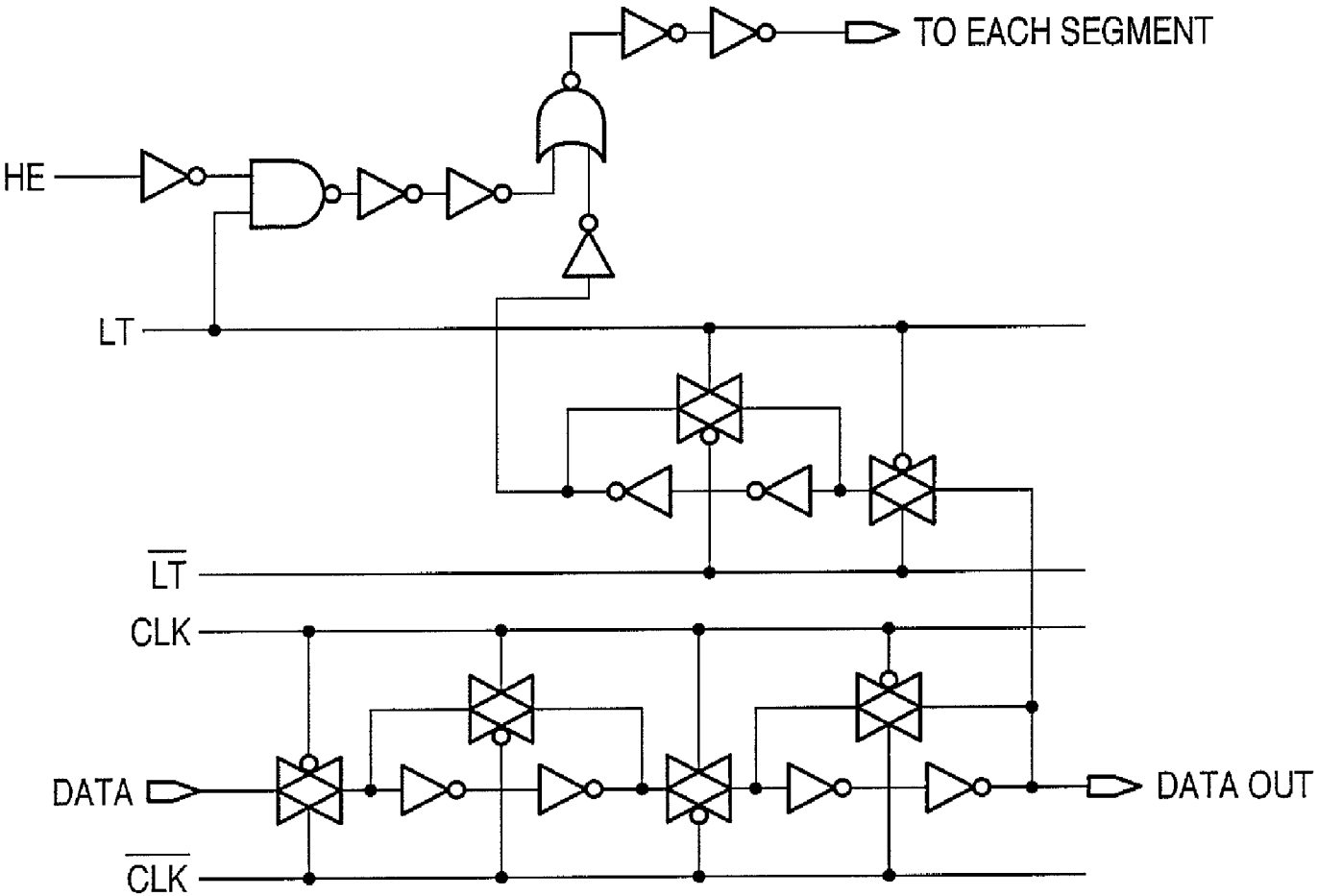
FIG. 12 is an equivalent circuit diagram of a circuit corresponding to one bit of a shift register 103 and latch circuit 104 which temporarily store print data.
Figure 13:
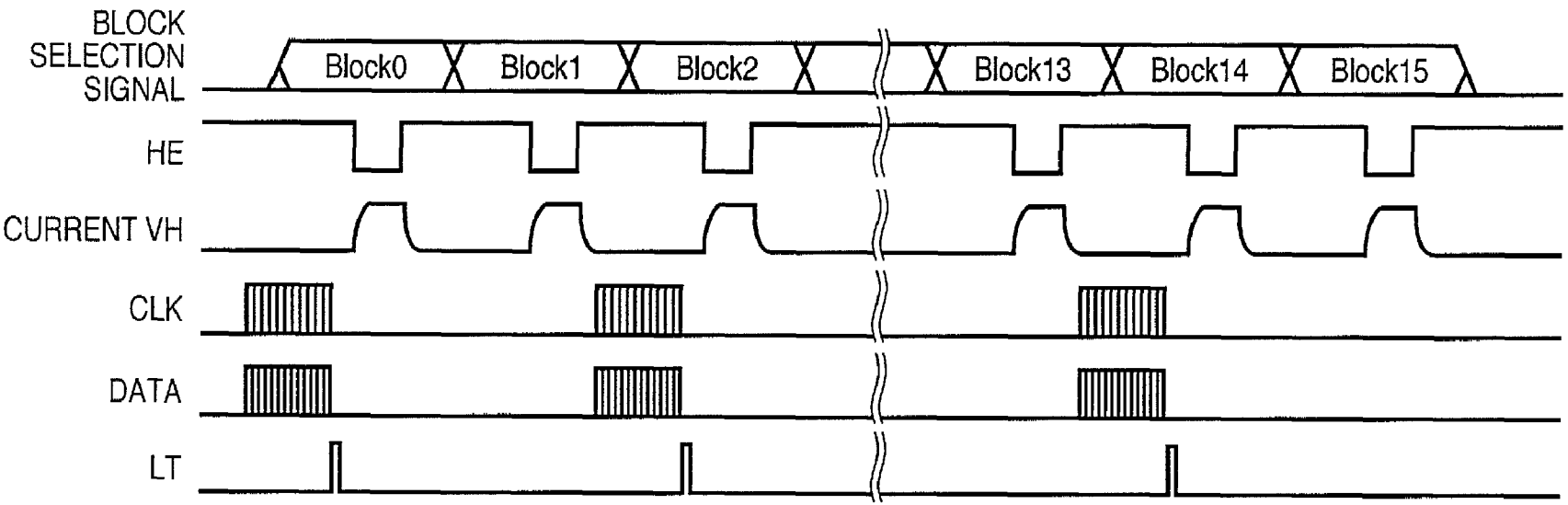
FIG. 13 is a timing chart for explaining a series of operations from receiving print data in the shift register 103 to driving the heater 206 by supplying a current to it.
Figure 14:
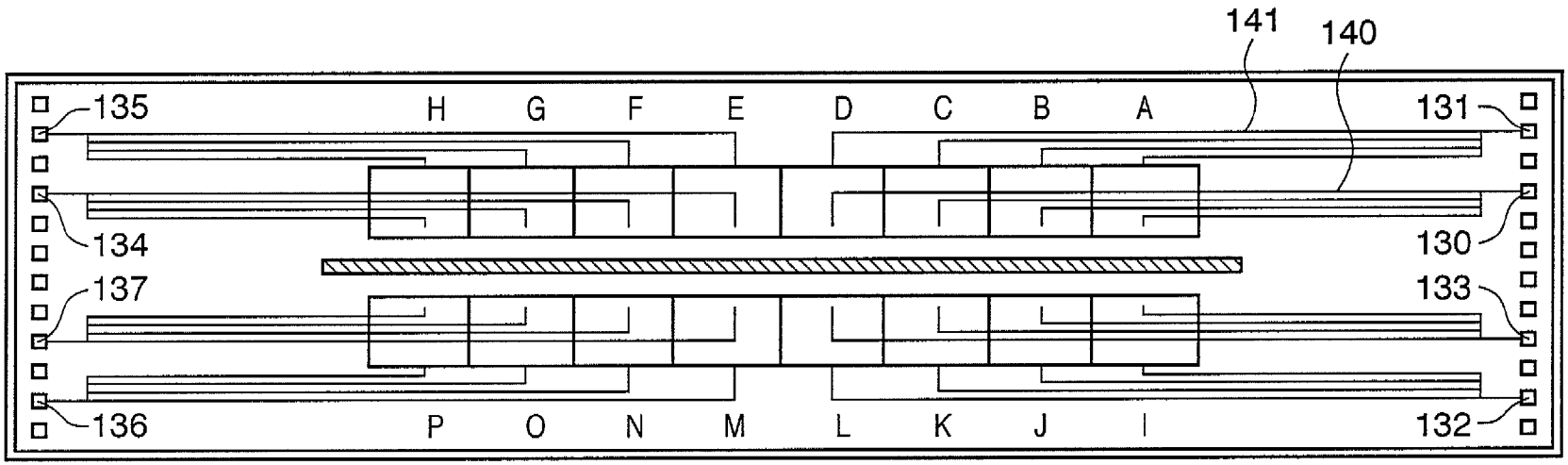
FIG. 14 is a view showing connection of power supply wiring lines in the head substrate shown in FIG. 10.

In FIG. 4, the same reference numerals as those in FIGS. 10 and 14 denote the same parts, and a description thereof will not be repeated. Only a characteristic layout in the embodiment will be explained.

According to the embodiment, as is apparent from comparisons between FIG. 4, and FIGS. 10 and 14 showing the conventional art, the intervals between a plurality of driver arrays 101*b* on a conventional head substrate are widened. Power supply pads VH 130 and ground pads GND 131 corresponding to the power supply pads VH are arranged in areas between a driver array and its adjacent driver array.

Wiring lines 140 are arranged to independently supply power to the groups of divided heater arrays 101*a*' from the power supply pads VH 130 arranged in the areas formed by widening the intervals between the driver arrays 101*b*. Wiring lines 141 extend from the ground pads GND 131 to adjacent driver arrays 101*b*.

On the conventional head substrate, the heater array 101*a* elongated along the longer side direction of the head substrate is arranged. On the head substrate according to the embodiment, the heater arrays 101*a*' divided into groups are arranged along the longer side direction.

Figure 5:
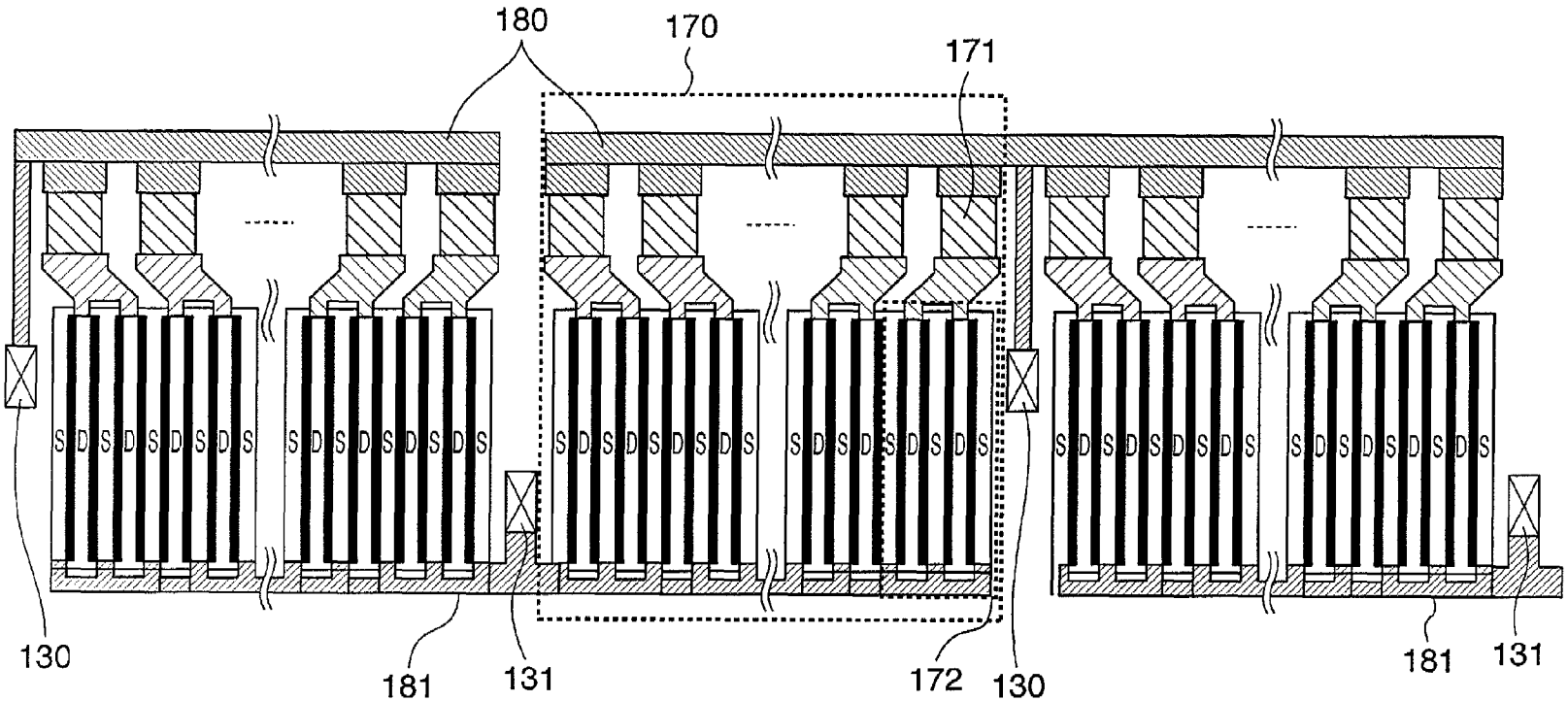
FIG. 5 is a view showing the wiring layout of the head substrate shown in FIG. 4.

FIG. 5 is a view showing the wiring layout of the head substrate shown in FIG. 4.

Figure 15:
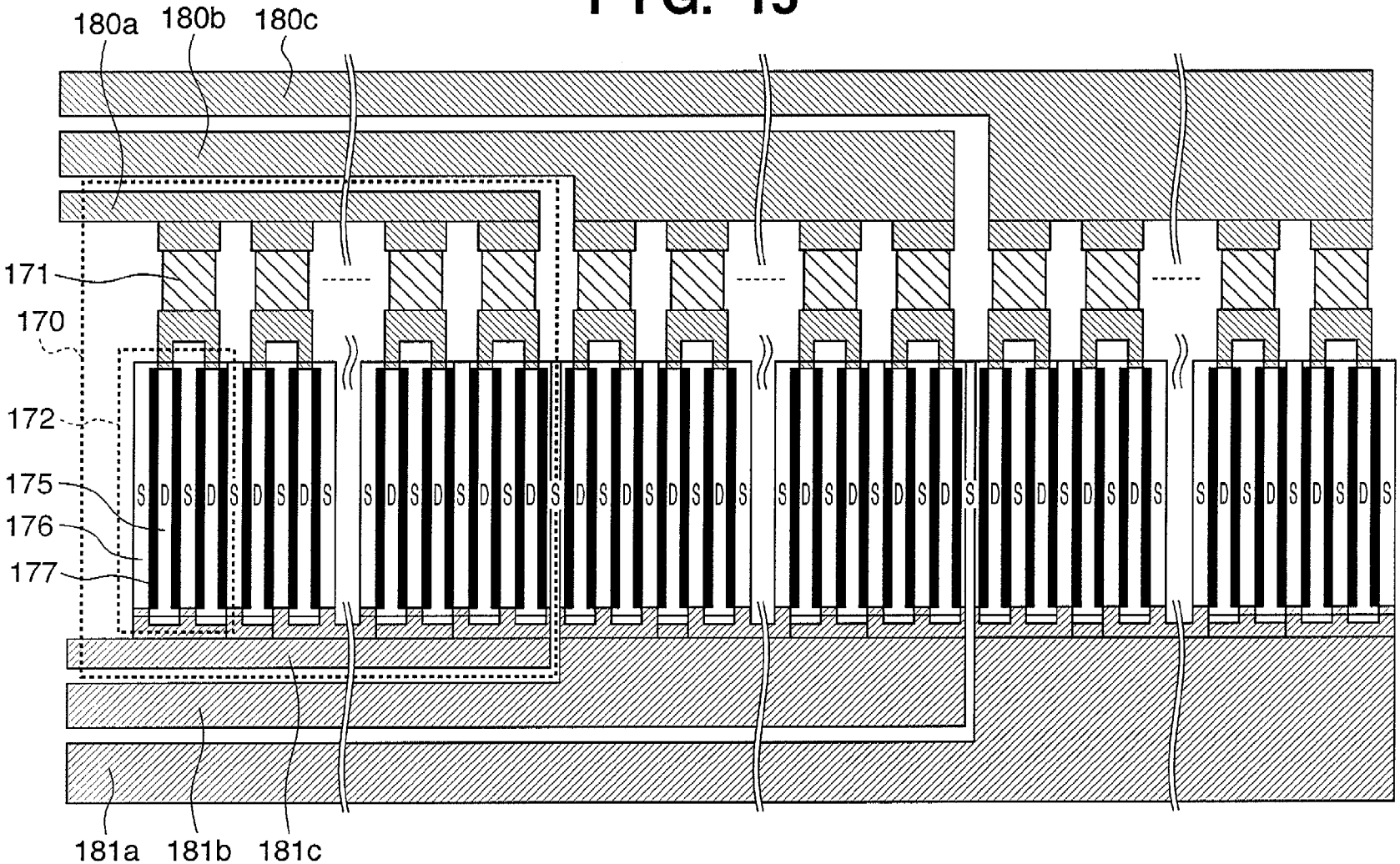
FIG. 15 is a layout view showing connection of power supply wiring lines in the head substrate shown in FIG. 14.

In FIG. 5, the same reference numerals as those in FIG. 15 denote the same parts, and a description thereof will not be repeated. Only a characteristic layout in the embodiment will be explained.

In FIG. 5, a VH power supply wiring line 180 extends from the power supply pad VH 130 and supplies VH power to each group 170. A current supplied from the power supply pad VH 130 is fed back through a GND wiring line 181 via the ground pad GND 131.

As is apparent from a comparison between FIGS. 5 and 15, the power supply pad VH 130 and ground pad GND 131 are arranged in areas between MOSFET 172 in one of groups 170 and MOSFET 172 in the adjacent one of groups 170. Thus, the lengths of the VH power supply wiring line and GND wiring line can be shortened.

In the embodiment, as shown in FIG. 5, the power supply pad VH 130 and ground pad GND 131 are respectively arranged every other area between adjacent groups. Power is supplied to groups on the two sides of one electrode. In this case, power wiring lines extending to the pads have the same resistance value.

By employing the above-described layout of the embodiment, the power supply pads VH and ground pads GND can be arranged in areas formed between adjacent driver arrays, and wiring lines can be individually laid out from the pads to adjacent segment groups including heaters. As a result, the wiring length from the power supply pad VH to the heater array and that from the ground pad GND to the driver array can be shortened.

Figure 6:
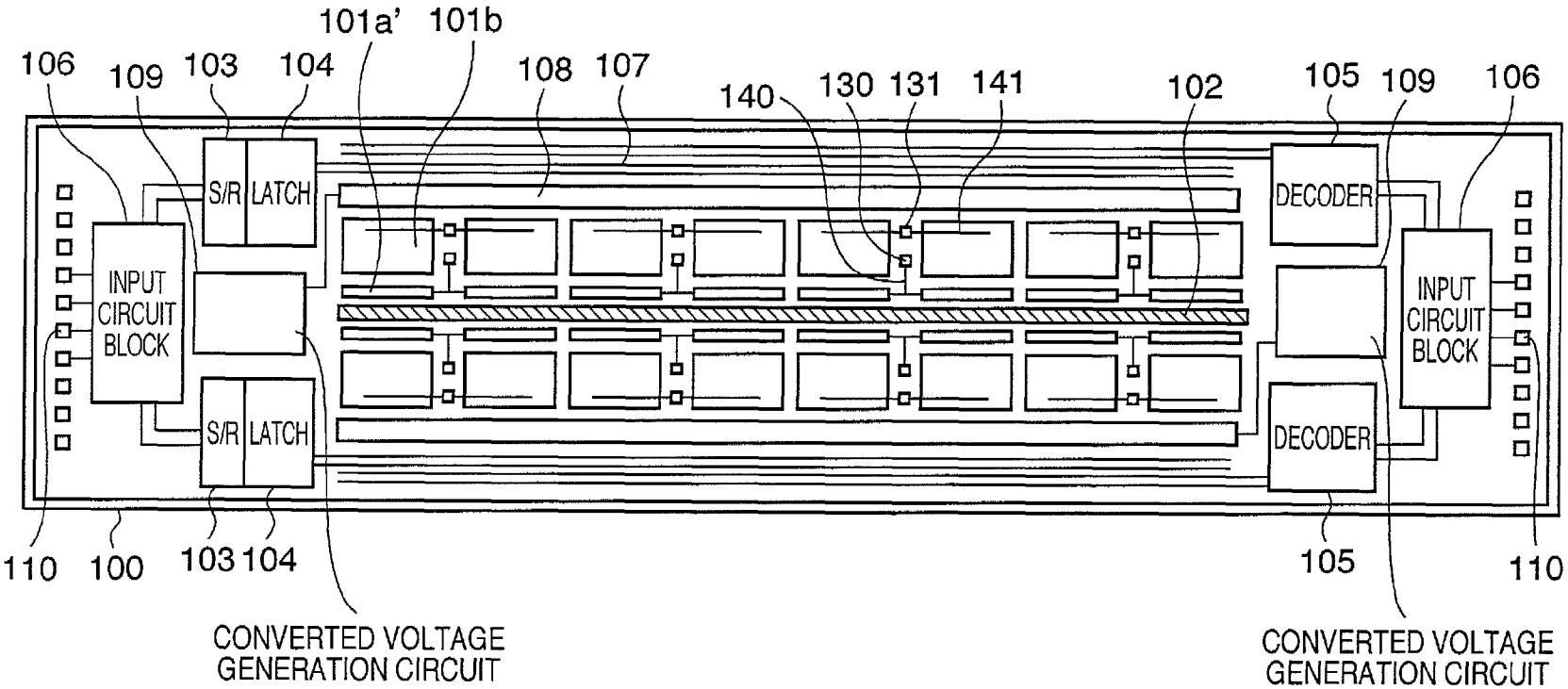
FIG. 6 is a view showing another layout of the head substrate according to the embodiment of the present invention.

FIG. 6 is a view showing another layout of the head substrate integrated into the printhead 3.

In FIG. 6, the same reference numerals as those in FIGS. 4, 10, and 14 denote the same parts, and a description thereof will not be repeated. Only a characteristic layout in FIG. 6 will be explained.

As is apparent from a comparison between FIGS. 6 and 4, the layout shown in FIG. 6 is different from that shown in FIG. 4 in connection of wiring lines extending from the power supply pad VH and ground pad GND. In this layout, both the power supply pad VH 130 and ground pad GND 131 are arranged between adjacent groups, and power is supplied to groups on the two sides of these pads. Also in this case, power wiring lines extending to the pads have the same resistance value.

Figure 7:
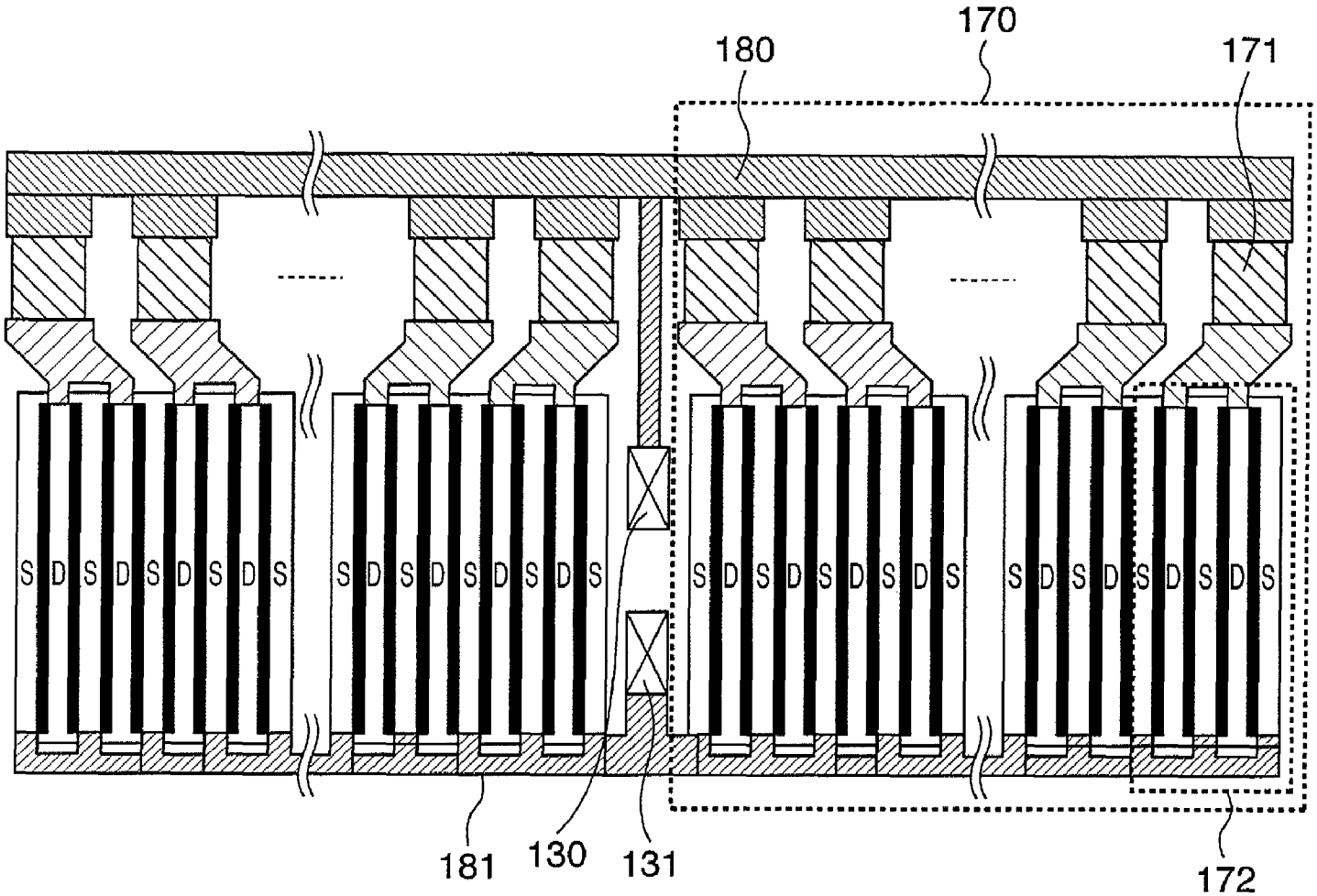
FIG. 7 is a view showing the wiring layout of the head substrate shown in FIG. 6.

FIG. 7 is a view showing the wiring layout of the head substrate shown in FIG. 6.

In FIG. 7, the same reference numerals as those in FIGS. 5 and 15 denote the same parts.

Figure 8:
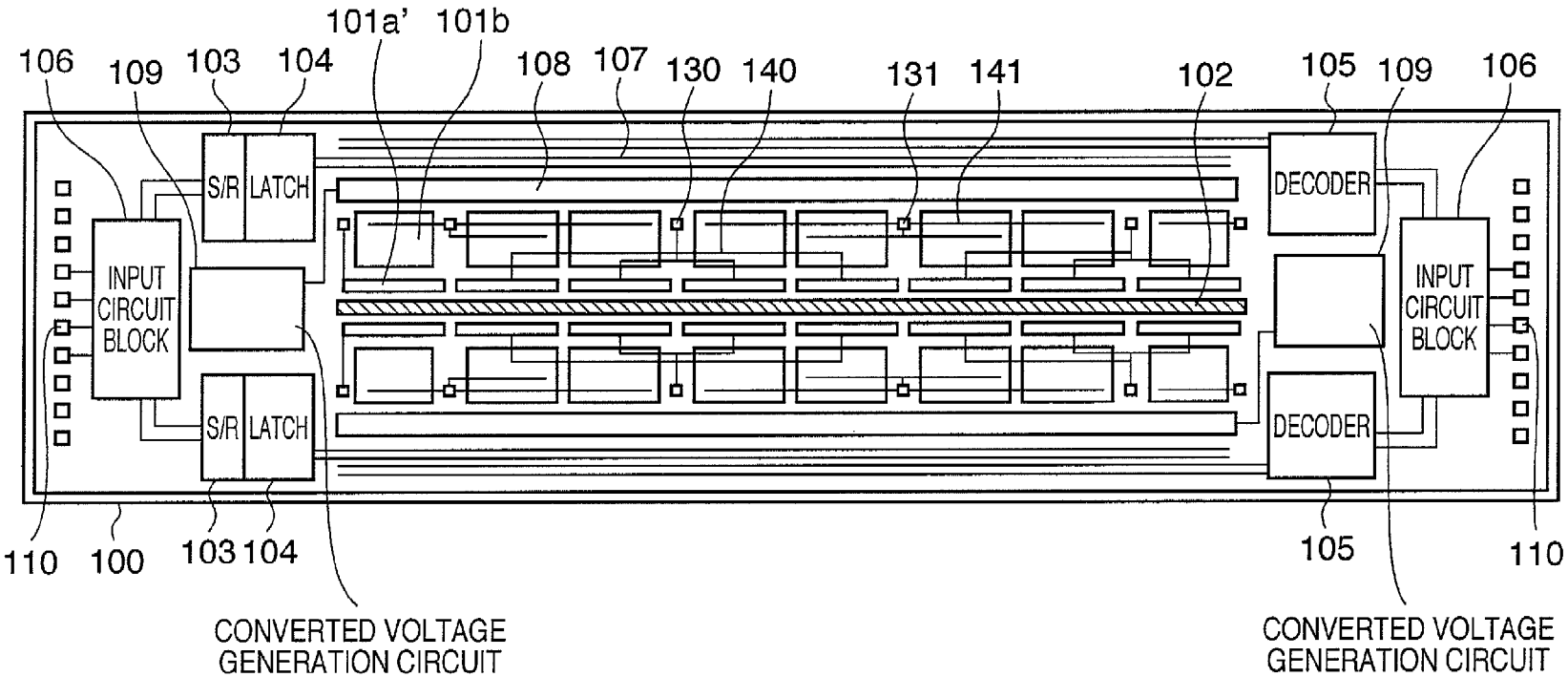
FIG. 8 is a view showing still another layout of the head substrate according to the embodiment of the present invention.

FIG. 8 is a view showing still another layout of the head substrate integrated into the printhead 3. In FIG. 8, the same reference numerals as those in FIGS. 4, 6, 10, and 14 denote the same parts, and a description thereof will not be repeated.

As is apparent from a comparison between FIGS. 8 and 4, in the layout shown in FIG. 8, power is supplied to two groups on each side of one pad. In this case, wiring lines extending to these two groups have different resistance values. To make the resistance values equal to each other, for example, the wiring width needs to be adjusted. However, electrodes suffice to be arranged every two areas between adjacent blocks. This layout is effective when a large area is ensured for driver transistors.

When a through-hole electrode is employed for each of the layouts shown in FIGS. 4, 6, and 8, it allows electrical connection to the power supply pad VH and ground pad GND from the back surface of the substrate. This results in further increasing layout efficiency of the whole head substrate, and downsizing the head substrate.

Figure 9:
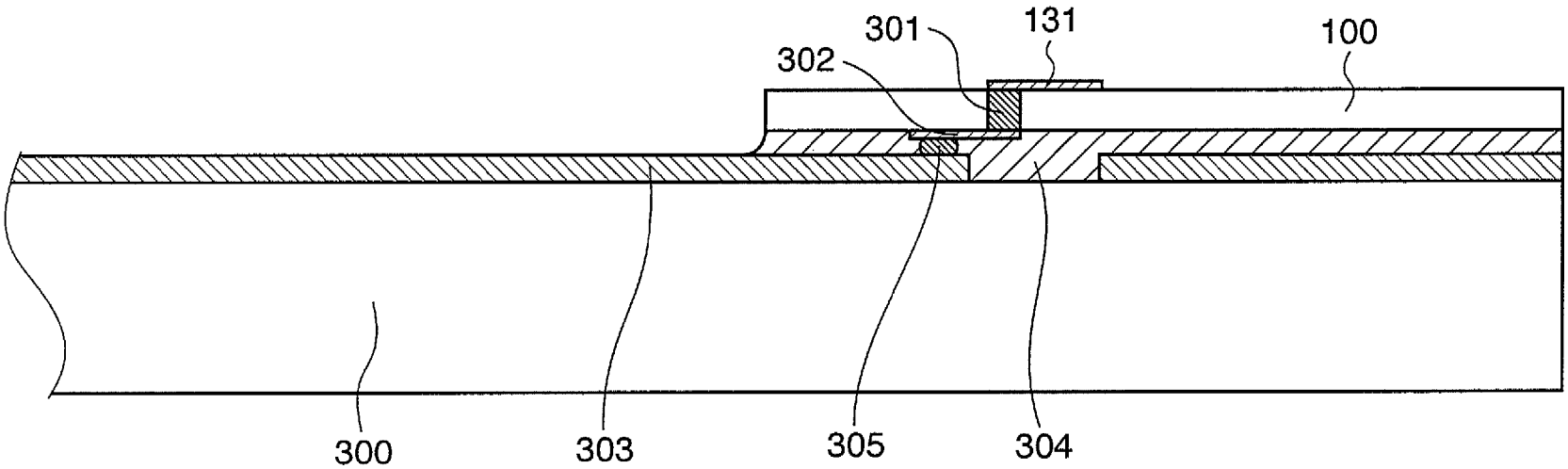
FIG. 9 is a side sectional view of a head substrate using a through-hole electrode.

FIG. 9 is a side sectional view of a head substrate using a through-hole electrode.

In this example, a through-hole electrode is formed on the back surface of a head substrate to connect a pad to an external electrode such as a flexible cable substrate. Also in FIG. 9, the same reference numerals as those described above denote the same parts, and a description thereof will not be repeated.

In FIG. 9, reference numeral 131 denotes a ground pad described above; 300, a flexible cable substrate; 301, a through-hole electrode; 302, a back surface wiring line; 303, a wiring line on the flexible cable substrate 300; and 304, an insulating material inserted between the head substrate 100 and the flexible cable substrate 300. Reference numeral 305 denotes a bumper which connects the back surface wiring line 302 and wiring line 303.

An arrangement of a through-hole electrode for a ground pad is illustrated here. However, a through-hole electrode for a power supply pad may be employed for connecting the power supply pad to the back surface wiring of the head substrate.

By employing this arrangement, the power supply wiring line can be connected to the back surface of the substrate and directly connected to an external electrode. This contributes to further decreasing the wiring resistance, and the effects of the present invention can be further enhanced.

Note that the total number of segment groups including heaters is 16 in the above description, but the present invention is not limited to this. The effects of the present invention can be similarly obtained regardless of the number of segment groups.

Three examples of laying out the power supply pad VH and ground pad GND between adjacent blocks have been described. However, the pad layout is not limited to them, and the effects of the present invention can be similarly obtained regardless of the number and combination of power supply pads VH and ground pads GND.

In the above-described embodiments, droplets discharged from the printhead are ink, and the liquid contained in the ink tank is ink. However, the content is not limited to ink. For example, the ink tank may also contain a process liquid which is discharged to a print medium in order to improve the fixing characteristic and water repellency of a printed image and improve the print quality.

In the above-described embodiments, high print density and high resolution can be achieved by, of inkjet printing methods, a method of changing the ink state by heat energy generated by a means (e.g., electrothermal transducer) for generating heat energy to discharge ink.

In addition, the inkjet printing apparatus according to the present invention may also take the form of an image output apparatus for an information processing apparatus such as a computer, the form of a copying apparatus combined with a reader or the like, and the form of a facsimile apparatus having transmission and reception functions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-328836, filed Dec. 5, 2006, which is hereby incorporated by reference herein in its entirety.

What is claimed is:

1. A head substrate used in an inkjet printhead, comprising:

an ink supply channel which is arranged along a longer side direction of the head substrate;

a plurality of printing element arrays which are arranged on at least one side of said ink supply channel, and each of which has a plurality of printing elements for printing by discharging ink supplied from the said ink supply channel;

a plurality of driving element arrays which are arranged adjacent to said plurality of printing element arrays on the same side of said ink supply channel as the side on which said plurality of printing element arrays are arranged, and which have a plurality of driving elements for driving the plurality of printing elements forming said plurality of printing element arrays;

a plurality of power supply pads which are arranged in plural areas between said plurality of driving element arrays along the longer side direction of the head substrate, and supply power to the plurality of printing elements of neighboring printing element arrays out of said plurality of printing element arrays; and a plurality of ground pads which are arranged in the areas and correspond to said plurality of power supply pads.

2. The head substrate according to claim 1, wherein each of said plurality of power supply pads is arranged in every other area out of the plural areas which are each disposed between two driving element arrays adjacent to each other out of said plurality of driving element arrays, and each of said plurality of ground pads is arranged in every other area where said plurality of power supply pads are not arranged, out of the plural areas.

3. The head substrate according to claim 1, wherein one of said plurality of power supply pads and one of said plurality of ground pads are both arranged in every other area out of the plural areas which are each disposed between two driving element arrays adjacent to each other out of said plurality of driving element arrays.

4. The head substrate according to claim 1, wherein each of said plurality of power supply pads and each of said plurality of ground pads are separately arranged in every other area out of the plural areas which are each disposed between two driving element arrays adjacent to each other out of said plurality of driving element arrays.

5. The head substrate according to claim 1, wherein said plurality of printing element arrays and said plurality of driving element arrays are arranged on both sides of said ink supply channel.

6. The head substrate according to claim 1, wherein said plurality of power supply pads and said plurality of ground pads are connected via a through-hole extending through the head substrate to a wiring provided on a surface opposite to a surface having said plurality of printing element arrays and said plurality of driving element arrays.

7. The head substrate according to claim 1, wherein each of the plurality of printing elements includes an electrothermal transducer which generates heat energy used to discharge ink.

8. A printhead using a head substrate according to claim 1.

9. A head cartridge integrating a printhead according to claim 8 and an ink tank containing ink to be supplied to the printhead.

10. A printing apparatus using a printhead according to claim 8.

* * * * *